US008948977B2

(12) United States Patent
Liu et al.

(10) Patent No.: US 8,948,977 B2
(45) Date of Patent: Feb. 3, 2015

(54) SYSTEMS AND METHODS FOR MACHINE IMPLEMENT CONTROL

(75) Inventors: Forrest Liu, Peoria, IL (US); William Ostler, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 413 days.

(21) Appl. No.: 13/338,336

(22) Filed: Dec. 28, 2011

(65) Prior Publication Data

US 2013/0173122 A1 Jul. 4, 2013

(51) Int. Cl.
*G06F 7/70* (2006.01)

(52) U.S. Cl.
USPC ..... 701/50; 701/19; 701/123; 180/170; 180/324; 180/333

(58) Field of Classification Search
CPC ..... G06F 7/00; B01D 33/76; E02F 3/405; G05D 19/02
USPC ..... 701/50
See application file for complete search history.

(56) References Cited

U.S. PATENT DOCUMENTS

| | | | | |
|---|---|---|---|---|
| 5,582,069 | A * | 12/1996 | Genise | 74/335 |
| 5,860,231 | A | 1/1999 | Lee et al. | |
| 5,996,703 | A * | 12/1999 | Yamamoto et al. | 172/4.5 |
| 6,757,992 | B1 | 7/2004 | Berger et al. | |
| 7,066,275 | B1 * | 6/2006 | Keigley | 171/63 |
| 7,117,952 | B2 | 10/2006 | Bares et al. | |
| 8,172,030 | B2 * | 5/2012 | Sewell et al. | 180/324 |
| 8,649,963 | B2 * | 2/2014 | Young et al. | 701/123 |
| 2001/0046433 | A1 * | 11/2001 | Nishimura et al. | 414/694 |
| 2005/0087378 | A1 * | 4/2005 | Hrazdera | 180/170 |
| 2005/0211449 | A1 * | 9/2005 | Bares et al. | 172/2 |
| 2008/0065297 | A1 * | 3/2008 | Brickner et al. | 701/50 |
| 2008/0183356 | A1 * | 7/2008 | Kale et al. | 701/50 |
| 2008/0208416 | A1 * | 8/2008 | Yuet et al. | 701/50 |
| 2009/0056322 | A1 * | 3/2009 | Brinkman et al. | 60/325 |
| 2009/0177335 | A1 * | 7/2009 | Young et al. | 701/1 |
| 2009/0215543 | A1 * | 8/2009 | Brissette | 464/181 |
| 2010/0152981 | A1 * | 6/2010 | Nishi et al. | 701/50 |
| 2011/0153170 | A1 * | 6/2011 | Dishman et al. | 701/50 |
| 2013/0173122 | A1 * | 7/2013 | Liu et al. | 701/50 |

FOREIGN PATENT DOCUMENTS

| | | | |
|---|---|---|---|
| JP | 59068444 | | 4/1984 |
| JP | 59068446 | | 4/1984 |
| JP | 07-090879 | A | 4/1995 |
| JP | 2006-018675 | A | 1/2006 |
| KR | 20-0283459 | Y1 | 7/2002 |
| KR | 20090115339 | A * | 11/2009 |

* cited by examiner

*Primary Examiner* — Redhwan k Mawari
(74) *Attorney, Agent, or Firm* — Finnegan, Henderson, Farabow, Garrett & Dunner LLP

(57) ABSTRACT

A system for controlling an implement of a machine is disclosed. The system may have a machine velocity sensor that senses an actual machine velocity and a targeted machine velocity sensor that senses a targeted machine velocity. The system may also have a controller, and an actuator configured to move an implement responsive to commands received from the controller by an actuator controller. The controller may be configured to receive the actual machine velocity from the machine velocity sensor, receive the targeted machine velocity from the targeted machine velocity sensor, compare the actual machine velocity to the targeted machine velocity, and send a command to the actuator controller to shake the implement based on the comparison of the actual machine velocity to the targeted machine velocity.

17 Claims, 3 Drawing Sheets

SYSTEMS AND METHODS FOR MACHINE IMPLEMENT CONTROL

TECHNICAL FIELD

The present disclosure relates generally to methods and systems for controlling machine implements and more particularly, to methods and systems for shaking and moving machine implements based on a machine state.

BACKGROUND

Machines, such as dozers, loaders, tractors, compactors, and other types of machines may perform a variety of tasks, e.g., digging, loosening, carrying, compacting, etc., different materials. These machines often include one or more implements, e.g., a blade, bucket, ripper, etc., to perform such tasks. For example, a blade or bucket may be used to dig or carry earth materials, while a ripper may be used to loosen the materials prior to or during digging.

The state of these implements may impact the efficiency of the machine. For example, a machine equipped with a blade or bucket may dump material in a particular location by raising and tilting (or pitching) the blade or bucket. However, it is possible that a certain amount of earth material may remain attached to the blade or bucket after dumping. This remaining material may then decrease the volume of the bucket for the next load to be carried, or may fall out of the bucket at a later time, requiring an additional pass to move the fallen material to the correct location. To enhance the efficiency of such machines, various implements of the machines may be shaken and/or vibrated to remove this material.

An exemplary system that may be used to remove such material using machine vibration is disclosed in U.S. Pat. No. 7,117,952 to Bares et al. that issued on Oct. 10, 2006 (the '952 patent). The system in the '952 patent enables an activation state based on the lift, tilt, or load of an attachment member such as a bucket. When the activation state is enabled, an automatic vibration mechanism vibrates the bucket, which may cause material clinging to the bucket to release and fall out.

Although the system of the '952 patent may be useful for loosening clinging material during a dumping process, the system may not allow the machine to operate in the most efficient manner. For example, the system of the '952 patent generally considers bucket lift, tilt, and load to enable an activation state, but does not consider other inputs, which may further increase the efficiency of the machine.

The disclosed machine implement control system is directed to overcoming one or more of the problems set forth above and/or other problems of the prior art.

SUMMARY

In one aspect, the present disclosure is directed to a computer-implemented method for controlling an implement of a machine. The method may include receiving an actual machine velocity and a targeted machine velocity, and comparing the actual machine velocity to the targeted machine velocity. The method may also include sending a command to an actuator controller to shake the implement based on the comparison of the actual machine velocity to the targeted machine velocity.

In another aspect, the present disclosure is directed to a system for controlling an implement of a machine. The system may include a machine velocity sensor that senses an actual machine velocity and a targeted machine velocity sensor that senses a targeted machine velocity. The system may also include a controller, and an actuator configured to move an implement responsive to commands from the controller received by an actuator controller. The controller may be configured to receive the actual machine velocity from the machine velocity sensor and receive the targeted machine velocity from the targeted machine velocity sensor. The controller may also be configured to compare the actual machine velocity to the targeted machine velocity and send a command to the actuator controller to shake the implement based on the comparison of the actual machine velocity to the targeted machine velocity.

In yet another aspect, the present disclosure is directed to a computer-readable storage device storing instructions for controlling an implement of a machine. The instructions may cause one or more computer processors to receive an actual machine velocity and a targeted machine velocity, compare the actual machine velocity to the targeted machine velocity, and generate a command to send to an actuator controller to shake the implement based on the comparison of the actual machine velocity to the targeted machine velocity.

DETAILED DESCRIPTION

Figure 1:
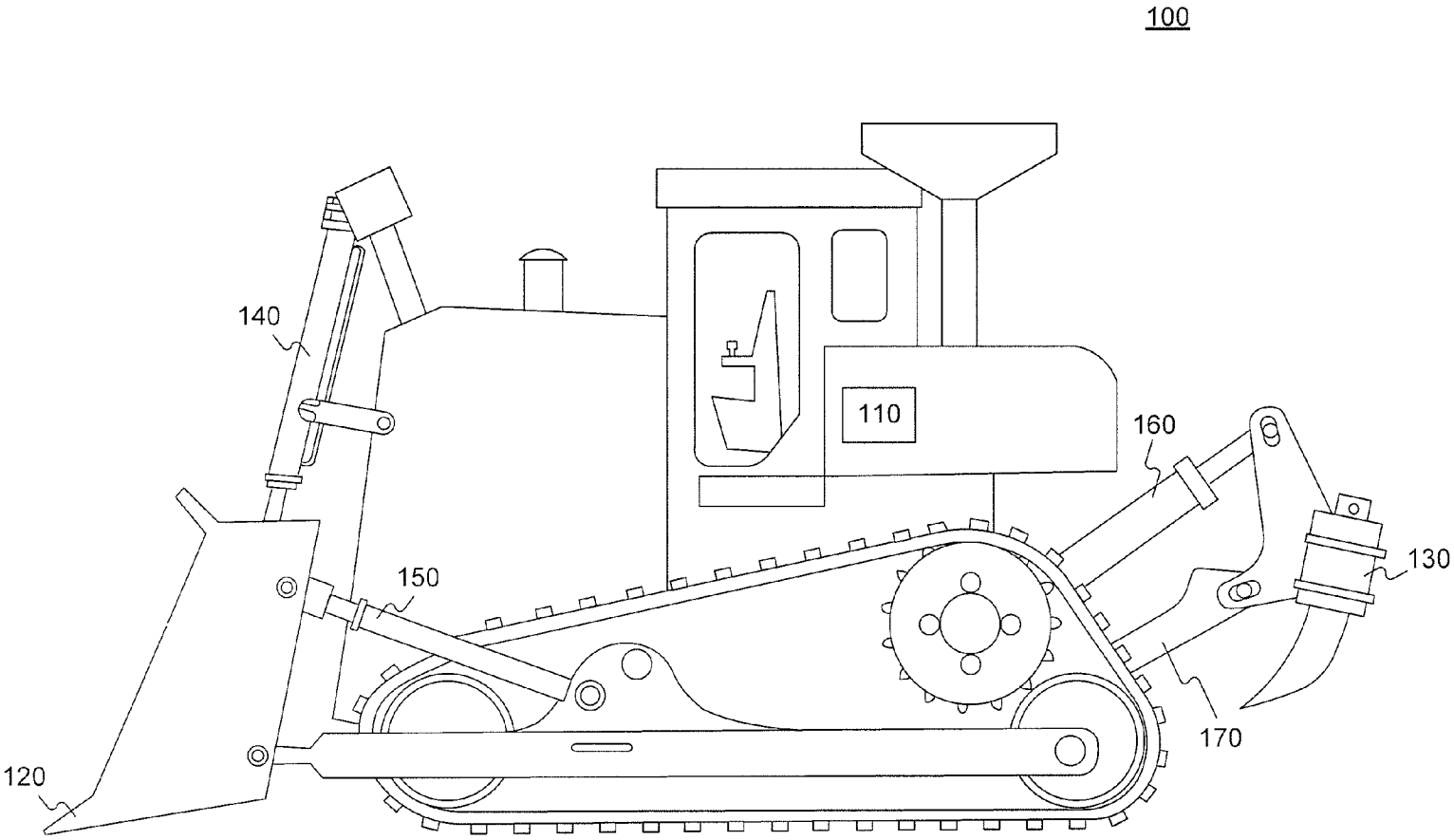
FIG. 1 is a pictorial illustration of an exemplary disclosed work machine.

FIG. 1 illustrates a machine 100 having an exemplary disclosed implement control system 110. Machine 100 may embody a machine configured to perform some type of operation associated with an industry such as mining, construction, farming, transportation, or any other industry known in the art. For example, machine 100 may be a dozer, loader, tractor, compactor, or any other type of machine that may perform a variety of tasks, e.g., digging, loosening, carrying, compacting, etc., different materials. Moreover, while machine 100 is a track-based machine, other embodiments may also include wheel-based machines.

Implement control system 110 may control one or more implements of machine 100, e.g. a blade 120, and/or a ripper 130. Of course, machine 100 may include any other types of implements, e.g., buckets, backhoes, augers, etc., which may also be controlled by implement control system 110. Implement control system 110 may be included in the electronic control unit (ECU) of machine 100 (not shown) or may be provided separately from the ECU. Moreover, while implement control system 110 is shown located in a single location in FIG. 1., implement control system 110 can be located anywhere, and at multiple locations on machine 100. For example, as discussed in greater detail below with regard to FIG. 2, implement control system 110 may include various sensors and controllers located throughout machine 100 that may be interconnected, e.g., via a network.

Machine 100 may use blade 120 to move different materials, such as sand, soil, or any other material. Implement control system 110 may control the orientation and movement of blade 120 using one or more actuators. For example, in FIG. 1, implement control system 110 may control blade 120 using a lift cylinder 140 and a tilt cylinder 150 as actuators. In one embodiment, lift cylinder 140 and tilt cylinder 150 may be hydraulic cylinders. By moving its piston rod in and out, lift cylinder 140 may control blade 120 to move up and down. Likewise, by moving its piston rod in and out, tilt cylinder 150 may control blade 120 to tilt forward or backward.

Machine 100 may use ripper 130 to break up material, such as hardened earth material. Implement control system 110 may likewise control the orientation and movement of ripper 130 using one or more actuators. For example, in FIG. 1, implement control system 110 may control ripper 130 using a shank cylinder 160 and a raise mechanism 170. In one embodiment, shank cylinder 160 may be a hydraulic cylinder. Likewise, raise mechanism 170 may also include a hydraulic cylinder (not shown). By moving its piston rod in and out, shank cylinder 160 may control ripper 130 to rotate forward or backward. Similarly, by moving its piston rod in and out, raise mechanism 170 may control ripper 130 to move up and down. While a single-shank ripper is disclosed in FIG. 1, ripper 130 may comprise any number of shanks. For example, in one embodiment, a ripper 130 may be a three-shank ripper.

Of course, the actuators used to control blade 120 and/or ripper 130 are not limited to cylinders or hydraulic cylinders, and those skilled in the art will appreciate that any type of actuator capable of controlling blade 120 and/or ripper 130 may be used. Moreover, the actuators used to control blade 120 and/or ripper 130 may be provided at any orientation with respect to blade 120 and/or ripper 130, so as to move blade 120 and/or ripper 130 in any direction or about any desired axis.

Figure 2:
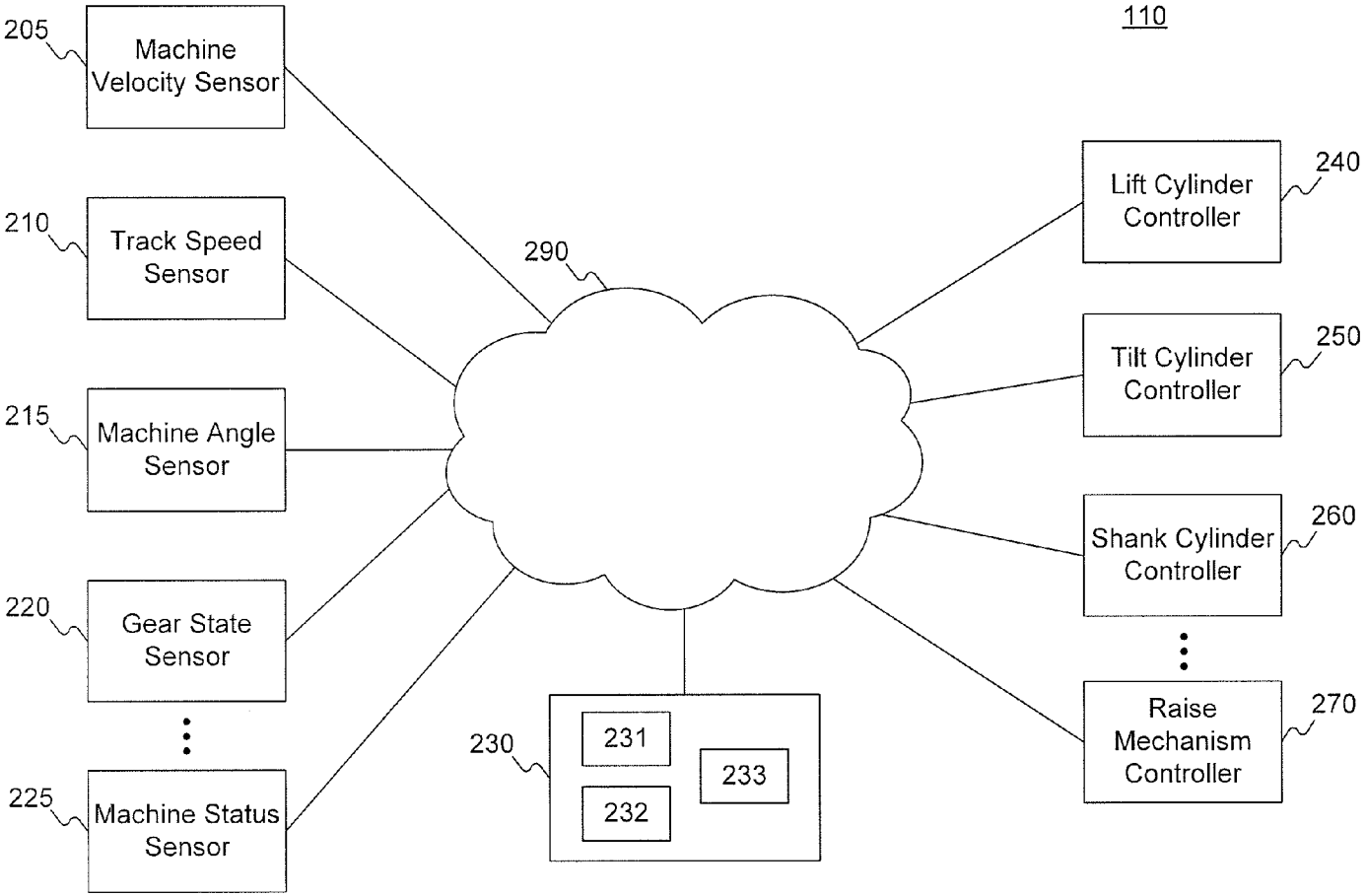
FIG. 2 is a diagrammatic illustration of an exemplary implement control system that may be used in conjunction with the machine of FIG. 1.

FIG. 2 is a diagrammatic illustration of an exemplary implement control system 110 that may be used in conjunction with machine 100 of FIG. 1. Implement control system 110 may include sensors 205-225, a controller 230, and actuator controllers 240-270 connected via a network 290.

Sensors 205-225 may include any sensor capable of measuring one or more machine characteristics or values. For example, sensors 205-225 may include one or more machine velocity sensors, accelerometers, gyroscopes, inclinometers, inertial measurement units, global positioning system (GPS) receivers, gear status sensors, machine state sensors, or any other type of sensor.

In certain embodiments, sensors 205-225 may include a machine velocity sensor 205, a track speed sensor 210, a machine angle sensor 215, a gear state sensor 220, and machine status sensors 225. Machine velocity sensor 205 may be configured to measure the velocity of machine 100, using, e.g., GPS data. Track speed sensor 210 may be located, e.g., on a track driving sprocket of machine 100 and may be configured to measure a track speed of machine 100. In embodiments where machine 100 is wheel-based, sensor 210 may be located, e.g., on a wheel shaft of machine 100 and may be configured to measure the wheel speed of machine 100. Machine angle sensor 215 may be configured to measure an inclination angle of machine 100 using, e.g., one or more accelerometers and/or inclinometers. In one embodiment, machine angle sensor may be incorporated into an inertial measurement unit. Gear state sensor 220 may be configured to determine a current gear state of a machine. Machine status sensors 225 may include any type of sensors that may be capable of measuring a machine status. For example, machine status sensors 225 may measure an extension state of one or more of lift cylinder 140, tilt cylinder 150, shank cylinder 160, and raise mechanism 170 to estimate a position of blade 120 and/or ripper 130 and determine whether machine 100 is in a loading state, a dumping state, a ripping state, etc.

Controller 230 may include a processor 231, a storage 232, and a memory 233. Controller 230 may be configured to control one or more implements of machine 100, e.g., by sending commands to one or more of actuator controllers 240-270, discussed below. Processor 231 may include one or more known processing devices, such as a microprocessor from the Pentiuum™ or Xeon™ family manufactured by Intel™, the Turion™ family manufactured by AMD™, any of various processors manufactured by Sun Microsystems, or any other type of processor. Storage 232 may include a volatile or non-volatile, magnetic, semiconductor, tape, optical, removable, nonremovable, or other type of storage device or computer-readable medium. Storage 232 may store programs and/or other information, such as information related to processing data received from one or more of sensors 205-225 and sending commands to one or more of actuator controllers 240-270, as discussed in greater detail below. Memory 233 may include one or more storage devices configured to store information used by controller 230 to perform certain functions related to disclosed embodiments.

In one embodiment, memory 233 may include one or more implement control programs or subprograms loaded from storage 232 or elsewhere that, when executed by processor 231, perform various procedures, operations, or processes consistent with the disclosed embodiments. For example, memory 233 may include one or more programs that enable controller 230 to, among other things, collect data from sensors 205-225, process the data according to disclosed embodiments, and send commands to one or more of actuator controllers 240-270 in order to control implements such as blade 120 and ripper 130. For example, memory 233 may include one or more implement control programs that enable processor 231 to compare the machine velocity received from machine velocity sensor 205 to the track velocity received from track speed sensor 210, and generate and send a command to one or more of actuator controllers 240-270 to shake an implement of machine 100 based on the comparison.

In embodiments where implement control system 110 is part of the ECU of machine 100, controller 230 may send the commands directly to actuator controllers 240-270. In embodiments where implement control system 110 is provided separate from the ECU, controller 230 may send the commands to actuator controllers 240-270 through the ECU. That is, controller 230 may send the commands to shake an implement of machine 100 to the ECU of machine 100. The ECU may then send commands to one or more of actuator controllers 240-270 to shake the implements, in accordance with the commands received from controller 230.

Actuator controllers 240-270 may include any device capable of receiving a command from controller 230 and controlling the movement of an actuator responsive to the command. Actuator controllers 240-270 may each correspond to an actuator of machine 100. Thus, actuator controllers 240-270 may be configured to receive commands from controller 230 via network 290 and, responsive to those commands, control the movement of their corresponding actuators.

In embodiments where machine 100 includes lift cylinder 140, tilt cylinder 150, shank cylinder 160, and raise mechanism 170, actuator controllers 240-270 may include a corresponding lift cylinder controller 240, a tilt cylinder controller 250, a shank cylinder controller 260, and a raise mechanism controller 270. In one embodiment, lift cylinder controller 240, tilt cylinder controller 250, shank cylinder controller 260, and raise mechanism controller 270 may each include a hydraulic solenoid and/or hydraulic pump capable of providing pressurized hydraulic fluid, e.g., oil, to their corresponding cylinders/actuators in order to control their movement. Thus, one or more of actuator controllers 240-270 may receive a command from controller 230 to control the flow of hydraulic fluid within the cylinder and thus cause one or more of the corresponding actuators 140-170 to move, which may in turn move one or more implements of machine 100. Controller 230 may use these commands to change the position and/or orientation of one or more implements and/or to shake one or more implements according to disclosed embodiments.

For example, controller 230 may send commands to lift cylinder controller 240 and/or tilt cylinder controller 250 to shake blade 120. Controller 230 may send commands to both lift cylinder controller 240 and tilt cylinder controller 250 to shake blade 120, or may send commands to only one cylinder controller. In certain embodiments, controller 230 may send commands to tilt cylinder controller 250 to shake blade 120 while sending commands to lift cylinder controller 240 to lower or raise blade 120. Likewise, controller 230 may send commands to shank cylinder controller 260 and/or raise mechanism controller 270 to shake ripper 130. Controller 230 may send commands to both shank cylinder controller 260 and raise mechanism controller 270 to shake ripper 130, or may send commands to only one controller. In certain embodiments, controller 230 may send commands to shank cylinder controller 260 to shake ripper 130 while sending commands to raise mechanism controller 270 to lower or raise ripper 130.

Controller 230 may generate and send the commands to actuator controllers 240-270 that cause the corresponding actuator associated with the actuator controller to shake the implement at a frequency between 1 and 20 Hz and with a displacement between 1-10% of a full extension capacity of the actuator. In one embodiment, controller 230 may send commands such that the displacement is between 2-3% of the full extension capacity of the actuator. For example, if shank cylinder 160 has a full extension capacity of 2 meters, then controller 230 may send commands to shank cylinder controller 260 such that a displacement of the piston rod within shank cylinder 160 during shaking is between 4 and 6 centimeters, with a frequency of 1 to 20 Hz.

In certain embodiments, controller 230 may compare an actual velocity of machine 100, e.g., measured by machine velocity sensor 205, and a targeted velocity of machine 100, e.g., determined by track speed sensor 210, gear state sensor 220, or any other suitable device. The targeted velocity of machine 100 may be, for example, a desired velocity of machine 100 that may be obtained absent external forces, e.g., gravity, slipping, braking, etc. For example, the targeted velocity may be determined based on the track speed of machine 100. The track speed may be measured by track speed sensor 210, or may be calculated based on the current gear selection of machine 100, known gear ratios, and an output of a torque converter speed sensor, or by any other method. In other embodiments the targeted velocity may be determined based on an orientation of, or commands sent from, a controller of machine 100, such as a joystick or other device used by an operator to control machine 100. By comparing the actual velocity to the targeted velocity, controller 230 may determine whether a machine is in a slip state or a slide state. Controller 230 may then send commands to shake and to raise or lower one or more implements based on the detected state.

For example, if controller 230 determines that a machine velocity, $S_m$, received from machine velocity sensor 205 exceeds a targeted velocity, $S_t$, received from track speed sensor 210 by a threshold value, $T_1$, controller 230 may determine that machine 100 is in a slide state. The targeted velocity $S_t$ may correspond to, e.g., a track speed, and hence, a desired velocity of the machine. Thus, if the actual velocity $S_m$ of machine 100 exceeds its targeted velocity $S_t$ by a threshold value, then machine 100 may be in a state where other forces, e.g., gravity due to an incline, loss of traction due to loose ground, etc., are causing machine 100 to slide in an undesirable manner. One example may be if machine 100 is sliding downhill at a speed faster than its track is moving. Another example may be if the operator of machine 100 is applying brakes to machine 100, but machine 100 is still sliding. In such cases, machine 100 may be out of control and may pose safety hazards such as rolling, flipping, or crashing machine 100. Thus, if controller 230 determines that the machine is in a slide state, e.g., that $S_m$ exceeds $S_t$ by threshold $T_1$, controller 230 may generate and send commands to one or more of actuator controllers 240-270 to shake and lower one or more implements, such as blade 120 and/or ripper 130. Shaking and lowering blade 120 and/or ripper 130 may cause the implements to penetrate the ground and slow the actual velocity of machine 100 bringing it closer to its targeted velocity, and thus restoring control over machine 100.

In one embodiment, the amount by which controller 230 instructs one or more of actuator controllers 240-270 to lower the one or more implements may be proportional to the difference between machine velocity $S_m$ and targeted velocity $S_t$, and/or may be proportional to how much the difference exceeds threshold value $T_1$. Thus, a greater difference between $S_m$ and $S_t$ may result in controller 230 instructing actuator controllers 240-270 to lower the implements by a greater amount. Moreover, threshold value $T_1$ may be a predetermined value or may be configurable by a user. Threshold value $T_1$ may also be determined based on machine velocity $S_m$ and/or targeted velocity $S_t$. For example, threshold $T_1$ may a variable value that is 20% of the machine velocity $S_m$, such that controller 230 determines that machine 100 is in a slide state if $S_m$ exceeds $S_t$ by 20% of the value of $S_m$.

On the other hand, if controller 230 determines that targeted velocity $S_t$ exceeds machine velocity $S_m$ by a threshold value $T_2$, controller 230 may determine that machine 100 is in a slip state. A slip state may occur, for example, when machine 100 is moving material or breaking ground with blade 120 or ripper 130, respectively, but the amount of material being moved is too heavy or the ground is too hard. In this situation, the track of machine 100 may be moving at a faster rate than the machine is moving. This may lead to machine 100 stalling or failing, and may also lead to inefficient operation of machine 100. If controller 230 determines that machine 100 is in a slip state, e.g., that $S_t$ exceeds $S_m$ by $T_2$, controller 230 may generate and send commands to one or more of actuator controllers 240-270 to shake and raise one or more implements, such as blade 120 and/or ripper 130. Shaking and raising blade 120 may lessen the amount of material being moved by blade 120, which may allow the actual velocity $S_m$ of machine 100 to come closer to the targeted velocity $S_t$. Likewise, shaking and raising ripper 130 may decrease the penetration of ripper 130 in the ground, reducing the resistance created by ripper 130, and similarly allowing the actual velocity $S_m$ of machine 100 to come closer to the targeted velocity $S_t$.

In one embodiment, the amount by which controller 230 instructs actuator controllers 240-270 to raise the implements may be proportional to the difference between targeted velocity $S_t$ and machine velocity $S_m$, and/or may be proportional to how much the difference exceeds threshold value $T_2$. Moreover, threshold value $T_2$ may be a predetermined value or may be configurable by a user. Threshold value $T_2$ may also be determined based on targeted velocity $S_t$ and/or machine velocity $S_m$. For example, threshold $T_2$ may a variable value that is 20% of the machine velocity $S_m$, such that controller 230 determines that machine 100 is in a slip state if $S_t$ exceeds $S_m$ by 20% of the value of $S_m$.

When machine 100 is not in either a slip state or a slide state, controller 230 may also instruct actuator controllers 240-270 to shake and/or otherwise move one or more implements, such as blade 120 and ripper 130, based on one or more other states of machine 100. For example, controller 230 may determine when machine 100 is in a dumping state, e.g., unloading or dumping material being moved by blade 120, and may generate and send commands to actuator controllers 240-250 to enable efficient dumping of the material. Controller 230 may determine that a machine is in a dumping state based on an indication received, e.g., from gear state sensor 220 and/or from machine status sensors 225. For example, controller 230 may determine that a machine is in a dumping state when gear state sensor 220 sends a signal to controller 230 that machine 100 has shifted gears from a forward gear to a reverse gear. Similarly, controller 230 may determine that machine 100 is in a dumping state when gear state sensor 220 senses a forward gear, but machine 100 has a zero or near-zero forward velocity (measured, e.g., by machine velocity sensor 205 and/or track speed sensor 210). Moreover, controller 230 may determine that machine 100 is in a dumping state based on data received from machine status sensors 225 corresponding to a position and/or orientation of blade 120 that may represent a dumping state. If controller 230 determines that machine 100 is in a dumping state, controller 230 may send commands to one or more of actuator controllers 240-270 to shake implements, such as blade 120. For example, shaking blade 120 may enable more efficient dumping by ensuring that material that is clinging to blade 120 falls off during the dumping process.

If controller 230 determines that machine 100 is in a dumping state, controller 230 may also determine an inclination angle of machine 100 during the dumping state, and may send commands to actuator controllers 240-250 based on the inclination angle. For example, controller 230 may receive an inclination angle of machine 100, e.g., an angle measuring the tilt of machine 100 substantially in its direction of forward movement, from machine angle sensor 215. If controller 230 determines that machine 100 has an inclination angle less than a threshold inclination angle $-\theta_1$, e.g., that machine 100 is at a downhill angle, then controller 230 may generate and send commands to actuator controllers 240-250 to shake blade 120 at its current lift and tilt positions, without further lifting or tilting blade 120. On the other hand, if controller determines that machine 100 has an inclination angle greater than a threshold inclination angle $\theta_2$, e.g., that machine 100 is at an uphill angle, then controller 230 may generate and send commands to actuator controllers 240-250 to shake blade 120 while at the same time lifting and tilting blade 120. Likewise, if controller determines that machine 100 has an inclination angle that is both greater than or equal to $-\theta_1$ and less than or equal to $\theta_2$, e.g., that machine 100 is at a relatively level angle, then controller 230 may generate and send commands to actuator controllers 240-250 to shake, raise, and tilt blade 120. However, in this case, controller 230 may generate commands to raise and tilt blade 120 to a lesser degree than the commands generated when machine 100 is at an uphill angle.

In certain embodiments, the extent to which the commands generated by controller 230 instruct actuator controllers 240-250 to raise blade 120 may be proportional to the detected inclination angle. For example, controller 230 may send raise lift controller 140 a command to raise blade 120 higher for a larger inclination angle than for a smaller inclination angle.

Network 290 may include any one of or combination of wired or wireless networks. For example, network 290 may include wired networks such as twisted pair wire, coaxial cable, optical fiber, and/or a digital network. Network 290 may further include any network configured to enable communication via a CAN-bus protocol. Likewise, network 290 may include any wireless networks such as RFID, microwave or cellular networks or wireless networks employing, e.g., IEEE 802.11 or Bluetooth protocols. Additionally, network 290 may be integrated into any local area network, wide area network, campus area network, or the Internet.

INDUSTRIAL APPLICABILITY

Figure 3:
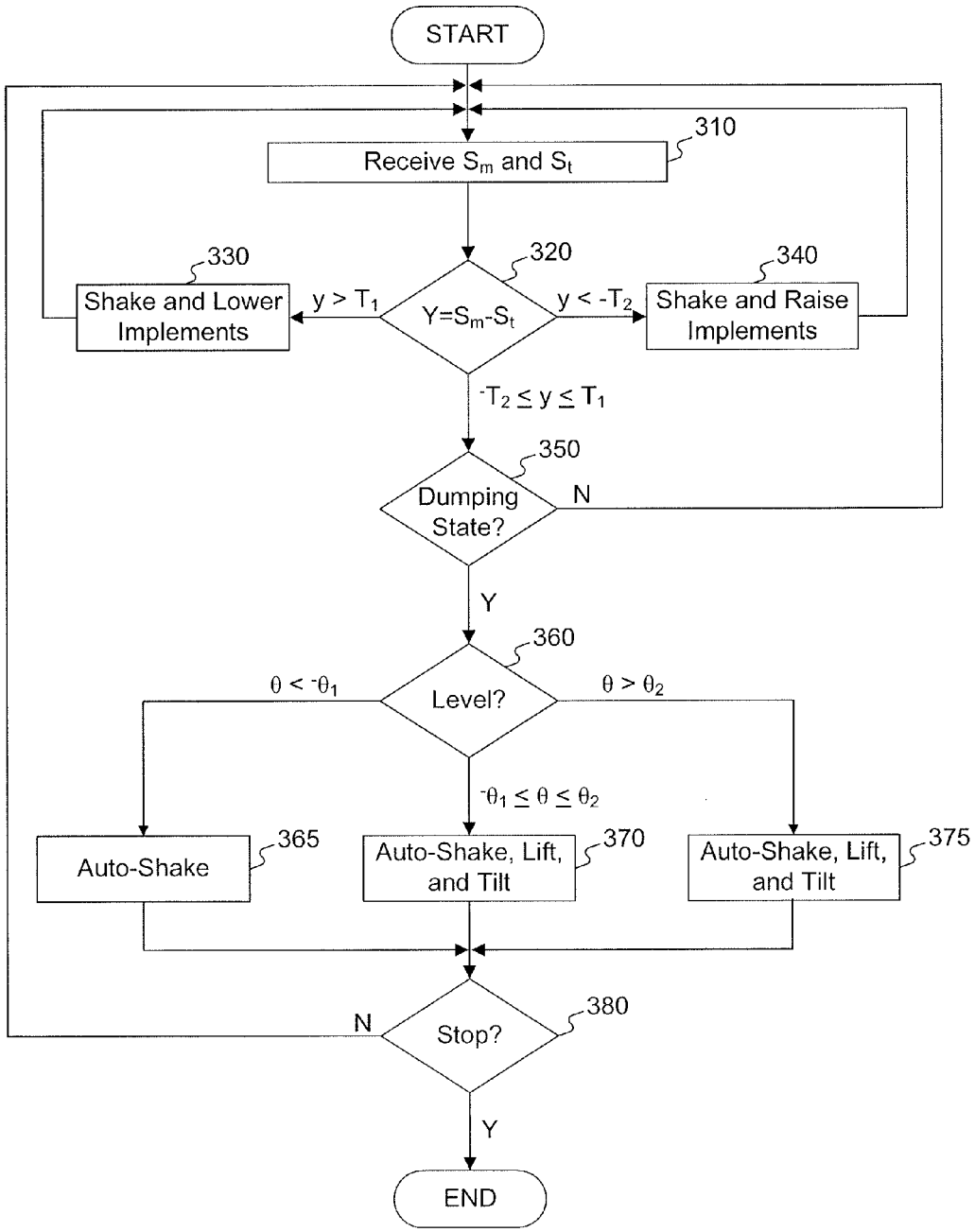
FIG. 3 is a flowchart depicting an exemplary disclosed method that may be performed by the control system of FIG. 2.

The disclosed implement control system 110 may be applicable to any machine with one or more implements. The disclosed implement control system 110 may provide for improved machine efficiency, improved dumping capabilities, and safer machine operation. The operation of implement control system 110 will now be described in connection with the exemplary flowchart of FIG. 3.

During operation of implement control system 100, controller 230 may receive an actual machine velocity $S_m$ and a targeted machine velocity $S_t$ (step 310). For example, controller 230 may receive actual machine velocity data from machine velocity sensor 205 and may receive targeted machine velocity data from track speed sensor 210. Moreover, as discussed above, in certain embodiments targeted machine velocity may be received, e.g., from a joystick or other device used to control machine 100. For example, the targeted velocity may be known based on an orientation of the joystick used to control machine 100.

Controller 230 may compare the actual machine velocity $S_m$ to the targeted machine velocity $S_t$ (step 320). For example, controller 230 may determine a value $y=S_m-S_t$. If y is greater than a predetermined threshold $T_1$, controller 230 may determine that machine 100 is in a slide state, and may generate and send commands to one or more actuator controllers, such as actuator controllers 240-270, to shake and lower one or more implements of machine 100, such as blade 120 and/or ripper 130 (step 330). If, on the other hand, controller 230 determines that y is less than a predetermined threshold $-T_2$, controller 230 may determine that machine 100 is in a slip state, and may generate and send commands to one or more actuator controllers, such as actuator controllers 240-270, to shake and raise one or more implements of machine 100, such as blade 120 and/or ripper 130 (step 340).

As discussed above, the amount by which controller 230 commands actuator controllers 240-270 to raise and/or lower the one or more implements may be based on a difference between actual machine velocity $S_m$ and a targeted machine velocity $S_t$ or based on an extent to which $S_m$ or $S_t$ differ from a threshold, such as $T_1$ or $T_2$. Moreover, after step 330 and/or step 340, processor 230 returns to step 310 to receive new values for $S_m$ and $S_t$ and compare them, as discussed with regard to steps 320-340. The process may repeat every 10 ms (or at any other time interval), until controller 230 determines that machine 100 is no longer in a slip state or a slide state.

If controller 230 determines that $-T_2 \leq y \leq T_1$, then controller 230 may determine that machine 100 is in neither a slip state nor a slide state, and may instead determine whether machine 100 is in a dumping state (step 350). If controller 230 determines that machine 100 is not in a dumping state (step 350, N), then controller 230 may return to step 310, where controller 230 again receives actual machine velocity and targeted machine velocity data. The process may then repeat itself, such that controller 230 determines every 10 ms (or at any other time interval) if machine 100 is in a slip state, a slide state, or a dumping state.

If, on the other hand, controller 230 determines that machine 100 is in a dumping state, then controller 230 may determine whether machine 100 is level (step 360). For example, controller 230 may receive an inclination angle θ of machine 100 from machine angle sensor 215, and may compare the received inclination angle to one or more threshold angles. If controller 230 determines that the received inclination angle θ is less than a first threshold inclination angle $-\theta_1$, then controller 230 may determine that machine 100 is at a downhill angle, and may send commands to shake blade 120, without lifting or tilting blade 120 (step 365).

On the other hand, controller 230 may determine that the received inclination angle θ is greater than a second threshold inclination angle $\theta_2$. In this case, controller 230 may determine that machine 100 is at an uphill angle, and may send commands to shake blade 120, while at the same time lifting and tilting blade 120 (step 375).

Controller 230 may determine that the received inclination angle θ is greater than a first threshold inclination angle $-\theta_1$ and is less than a second threshold inclination angle $\theta_2$. Thus, controller 230 may determine that machine 100 is in a relatively level orientation and may send commands to shake blade 120, while at the same time lifting and tilting blade 120 (step 370). However, at step 370, controller 230 may send commands to lift and tilt blade 120 to a lesser extent than it lifts and tilts blade 120 at step 375. For example, as discussed above, controller 230 may send commands to lift and tile blade 120 to an extent proportional to the received inclination angle θ.

After controller 230 sends commands to shake and/or lift and tilt blade 120 at steps 365, 370, or 375, controller 230 may determine whether a stop command has been received (step 380). A stop command may include, e.g., an operator turning off machine 100, or machine 100 receiving any other such command to stop performing material-moving operations. If controller 230 determines that a stop command has been received (step 380, Y), then controller 230 may stop performing the process of FIG. 3. On the other hand, if controller 230 determines that a stop command has not been received (step 380, N), then controller 230 may return to step 310, and may repeat the process of FIG. 3 every 10 ms, or at any other time interval.

It will be apparent to those skilled in the art that various modifications and variations can be made to the disclosed machine implement control system. Other embodiments will be apparent to those skilled in the art from consideration of the specification and practice of the disclosed machine implement control system. It is intended that the specification and examples be considered as exemplary only, with a true scope being indicated by the following claims and their equivalents.

What is claimed is:

1. A computer-implemented method for controlling an implement of a machine comprising:

receiving an actual machine velocity and a targeted machine velocity;

comparing the actual machine velocity to the targeted machine velocity;

determining a difference between the actual machine velocity and the targeted machine velocity;

sending a command to an actuator controller to shake the implement based on a determination that the difference between the actual machine velocity and the targeted machine velocity exceeds a predetermined value;

determining whether the machine is in a dumping state;

determining an inclination angle of the machine; and sending the command to the actuator controller to shake and raise the implement responsive to determining that the machine is in the dumping state and at least one of that the inclination angle is less than a first threshold inclination angle and that the inclination angle is greater than a second threshold inclination angle.

2. The computer-implemented method according to claim 1, further including:

determining that the actual machine velocity exceeds the targeted machine velocity by a threshold value; and sending the command to the actuator controller to shake and lower the implement responsive to the determination that the actual machine velocity exceeds the targeted machine velocity by the threshold value.

3. The computer-implemented method according to claim 2, wherein the command causes an actuator associated with the actuator controller to shake the implement at a frequency between 1 and 20 Hz and with a displacement between 1-10% of a full extension capacity of the actuator.

4. The computer-implemented method according to claim 1, further including:

determining that the targeted machine velocity exceeds the actual machine velocity by a threshold value; and sending the command to the actuator controller to shake and raise the implement responsive to the determination that the targeted machine velocity exceeds the actual machine velocity by the threshold value.

5. The computer-implemented method according to claim 4, wherein the command causes an actuator associated with the actuator controller to shake the implement at a frequency between 1 and 20 Hz and with a displacement between 1-10% of a full extension capacity of the actuator.

6. The computer-implemented method according to claim 1, further including:

sending the command to the actuator controller to shake and raise the implement responsive to determining that the machine is in the dumping state and that the inclination angle is greater than the second threshold inclination angle.

7. The computer-implemented method according to claim 6, further including:

in response to sensing a gear shift of the machine from a forward gear to a reverse gear, determining that the machine is in the dumping state.

8. A system for controlling an implement of a machine comprising:

a machine velocity sensor that senses an actual machine velocity;

a targeted machine velocity sensor that senses a targeted machine velocity;

an actuator configured to move an implement responsive to commands received at an actuator controller;

an inclination angle sensor that senses an inclination angle of the machine; and a controller configured to:

receive the actual machine velocity from the machine velocity sensor;

receive the targeted machine velocity from the targeted machine velocity sensor;

compare the actual machine velocity to the targeted machine velocity;

determine a difference between the actual machine velocity and the targeted machine velocity;

send a command to the actuator controller to shake the implement based on a determination that the difference between the actual machine velocity and the targeted machine velocity exceeds a predetermined value, receive the inclination angle from the inclination angle sensor;

determine whether the machine is in a dumping state; and send the command to the actuator controller to shake and raise the implement responsive to determining that the machine is in the dumping state and at least one of that the inclination angle is less than a first threshold inclination angle and that the inclination angle is greater than a second threshold inclination angle.

9. The system according to claim 8, wherein the controller is further configured to:

determine that the actual machine velocity exceeds the targeted machine velocity by a threshold value; and send the command to the actuator controller to shake and lower the implement responsive to the determination that the actual machine velocity exceeds the targeted machine velocity by the threshold value.

10. The system according to claim 8, wherein the actuator is configured to shake the implement at a frequency between 1 and 20 Hz and with a displacement between 1-10% of a full extension capacity of the actuator responsive to the command received by the actuator controller.

11. The system according to claim 8, wherein the controller is further configured to:

determine that the targeted machine velocity exceeds the actual machine velocity by a threshold value; and send the command to the actuator controller to shake and raise the implement responsive to the determination that the targeted machine velocity exceeds the actual machine velocity by the threshold value.

12. The system according to claim 8, further including:

a gear shift sensor that senses whether the machine has shifted gears from forward to reverse, wherein the controller is further configured to:

receive an indication from the gear shift sensor that the machine has shifted gears from a forward gear to a reverse gear, and determine that the machine is in the dumping state responsive to the indication received from the gear shift sensor.

13. A non-transitory computer-readable storage device storing instructions for controlling an implement of a machine, the instructions causing one or more computer processors to perform operations comprising:

receiving an actual machine velocity and a targeted machine velocity;

comparing the actual machine velocity to the targeted machine velocity;

determining a difference between the actual machine velocity and the targeted machine velocity;

generating a command to send to an actuator controller to shake the implement based on a determination that the difference between the actual machine velocity and the targeted machine velocity exceeds a predetermined value;

determining whether the machine is in a dumping state;

determining an inclination angle of the machine; and generating the command to send to the actuator controller to shake and raise the implement responsive to determining that the machine is in the dumping state and at least one of that the inclination angle is less than a first threshold inclination angle and that the inclination angle is greater than a second threshold inclination angle.

14. The computer-readable storage device according to claim 13, the instructions further causing the one or more computer processors to perform operations including:

determining that the actual machine velocity exceeds the targeted machine velocity by a threshold value; and generating the command to shake and lower the implement responsive to the determination that the actual machine velocity exceeds the targeted machine velocity by the threshold value.

15. The computer-readable storage device according to claim 13, the instructions further causing the one or more computer processors to perform operations including:

determining that the targeted machine velocity exceeds the actual machine velocity by a threshold value; and generating the command to shake and raise the implement responsive to the determination that the targeted machine velocity exceeds the actual machine velocity by the threshold value.

16. The computer-readable storage device according to claim 13, the instructions further causing the one or more computer processors to perform operations including:

generating the command to shake and raise the implement responsive to determining that the machine is in the dumping state and that the inclination angle is greater than the second threshold inclination angle.

17. The computer-readable storage device according to claim 13, the instructions further causing the one or more computer processors to perform operations including:

in response to sensing a gear shift of the machine from a forward gear to a reverse gear, determining that the machine is in the dumping state.

* * * * *